United States Patent [19]

Yang

[11] Patent Number: 4,535,659

[45] Date of Patent: Aug. 20, 1985

[54] TORQUE LIMITING WRENCH WITH AN AUDIO ALARM

[76] Inventor: Tai-Her Yang, 5-1 Tay Pyng St., Shi Hwu Jenn, Jang Huah Shiann, Taiwan

[21] Appl. No.: 547,922

[22] Filed: Nov. 2, 1983

[51] Int. Cl.[3] ..... B25B 23/142

[52] U.S. Cl. ..... 81/478; 81/476

[58] Field of Search ..... 81/467–468, 81/476, 478–479, 481–483; 74/519, 524, 531; 403/2, 159

[56] References Cited

U.S. PATENT DOCUMENTS 3,276,296 10/1966 Woods ..... 81/467

FOREIGN PATENT DOCUMENTS 2208878 1/1983 Fed. Rep. of Germany ..... 81/467

*Primary Examiner*—Frederick R. Schmidt
*Assistant Examiner*—Debra S. Meislin
*Attorney, Agent, or Firm*—Cushman, Darby & Cushman

[57] ABSTRACT

A torque limiting wrench for limiting the magnitude of torque applied to a load is disclosed. The wrench comprises a fore-section rod having a head structure of a wrench or adjustable wrench, a fore-section member depending from the head structure and having two prongs and, a rear-section rod having a rear-section member with two flanges and a step round hollow rod depending from the rear-section member. A pivot mechanism connects the fore-section member to the rear-section member and allows the rods to pivot. An operational handle has a hollow cylinder with a base. A link shaft projects from the base and passes through the step round hollow rod. At the distal end of the link shaft is an adjustment block which is received by the interior surfaces of the rear-section member; the adjustment block is driven by rotation of the operational handle to adjust the pressure between the fore and rear-section members. The wrench also has a position audio alarm which makes an audible signal when the rods pivot, that is when the torque applied to the wrench is too great.

13 Claims, 8 Drawing Figures

TORQUE LIMITING WRENCH WITH AN AUDIO ALARM

BACKGROUND OF THE INVENTION

Conventional hand tools with an integral body structure do not have a safety design to buffer applied torques, or to indicate the maximum safety scope for the applicable torques, and thus torques are often applied to nuts or bolts in excess of their load capacities causing damage which, in turn, leads to various operational difficulties. The present invention is a device which provides a buffer to the applied torques by its position audio alarm, and by a staggered movement of rods, thereby preventing thereby preventing damage to nuts and bolts (including their threads).

SUMMARY OF THE INVENTION

The present invention relates to a torque limiting wrench for limiting the magnitude of torque applied to a load. The wrench comprises a fore-section rod having a head structure of a wrench or adjustable wrench at one end and a fore-section member having two prongs at the other end and, a rear-section rod having a rear section member with two flanges at one end and a step round hollow rod at the other end. A pivot mechanism connects the fore-section member to the rear-section member and allows the rods to pivot. An operational handle has a hollow cylinder with a base. A link shaft projects from the base and passes through the step round hollow rod. At the distal end of the link shaft is an adjustment block which is received by the interior surfaces of the rear-section member; the adjustment block is driven by rotation of the operational handle to adjust the pressure between the fore and rear-section members. The wrench also has a position audio alarm which makes an audible signal when the rods pivot, that is when the torque applied to the wrench is too great.

BRIEF DESCRIPTION OF THE DRAWINGS

FIGS. 4-1, 4-2 and 4-3 are various cross-sectional views of the device of the present invention taken along line A—A of FIG. 5 showing different embodiments of the present invention.

DETAILED DESCRIPTION OF THE INVENTION

Figure 3:
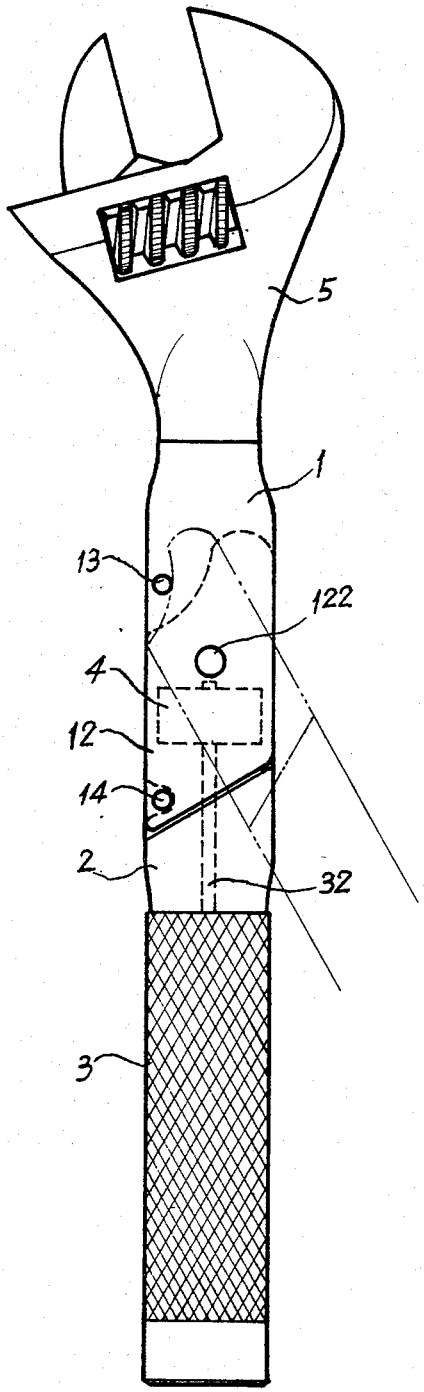
FIG. 3 is a side view of the device according to the present invention.
Figure 1:
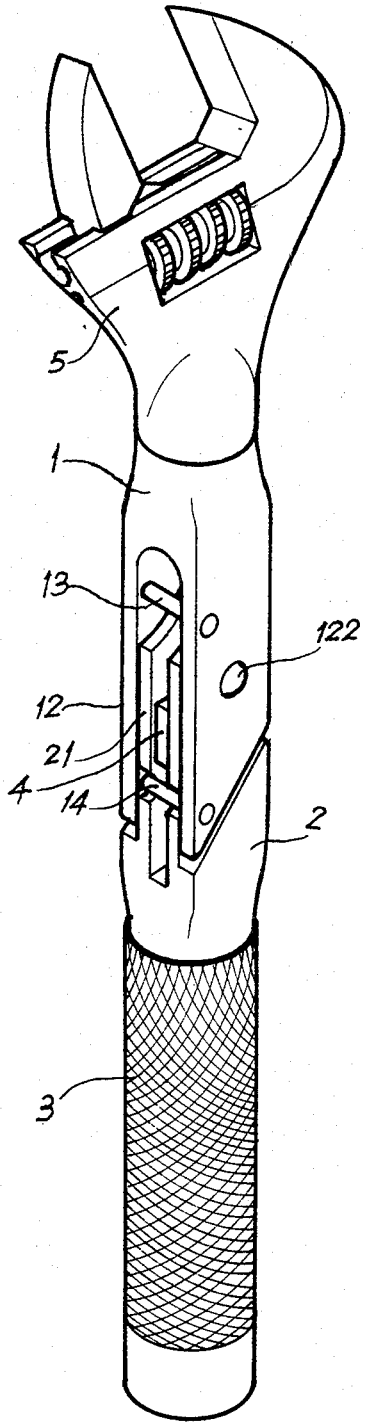
FIG. 1 is a perspective view of the device according to the present invention.
Figure 2:
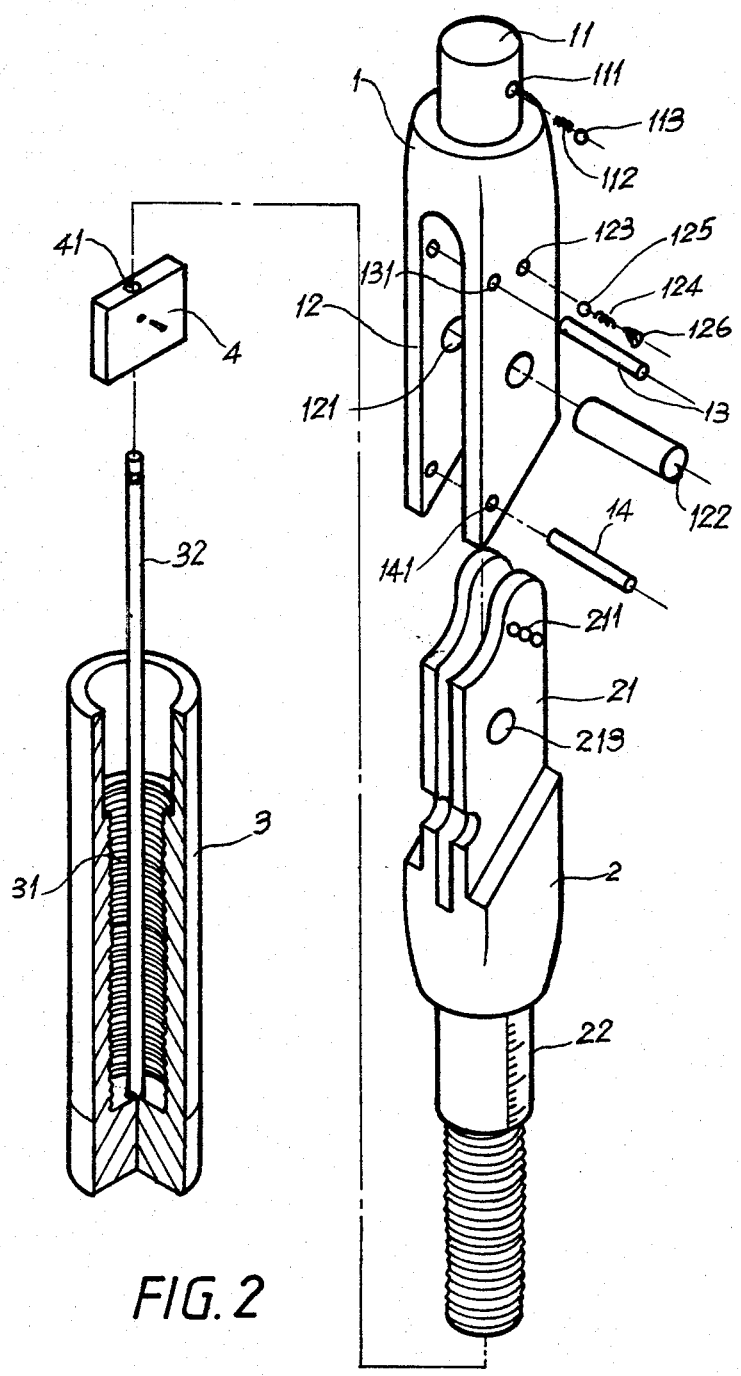
FIG. 2 is a perspective exploded view of the device according to the present invention.

Referring now to the drawings, this invention comprises a fore-section rod 1, a rear-section rod 2, an operational handle 3, a sliding-adjustment block 4 and a position audio alarm. A detailed description of the various elements of the device and their functions and features according to the present invention are noted below:

The fore-section rod 1 is shown in FIGS. 1 and 2, with a round cylinder 11. Round cylinder 11 can be replaced by a triangular body of a polygonal cylinder. On the side of round cylinder 11, a small hole 111 is provided; in this hole, a small spring ring 112 and a small steel bead 113 are inserted. The above-said elements provide a sleeve for various corresponding fixed or adjustable wrenches 5. The provision of a small steel bead 113 allows rotation about the sleeve of the round cylinder 11.

Also part of the fore-section rod 1 is the fore-section member 12 with a coupling hole 121 provided to accommodate and hold a coupling pin 122, shaft, screw and nut, or rivet in order to effect a connection. If a screw and a nut are used to connect the fore-section rod 1 and the rear-section rod 2, adjustment of the nut can change the amount of pressure on the prestress coupling faces between the above-said rods.

Near the coupling hole 121 of fore-section member 12 is a position audio alarm. On the upper end of the fore-section member 12, there is a small hole 123 in which spring ring 124 and a steel bead 125, or steel post or bulge point, and adjustment screw 126 are inserted. Turning the adjustment screw 126 forces the spring ring 124 and steel bead 125 to press against several round grooves 211 or indentations which are located at corresponding opposite positions on the rear-section member 21. Movement of the steel bead 125 in the indentations 211, creates an audible signal. The signal made by the position audio alarm indicates that the applied torque has reached the maximum permissible bearing torque. The steel bead 125 and grooves 211 also manifest the position-restoring and positioning functions.

On the upper end of the fore-section member 12, there is a catch and stop hole 131 to accommodate and hold the catch-and-stop pin 13. If the force applied to the operational handle 3 exceeds the pre-set torque, the rear-section member 21 rotates about the coupling pin 122 creating a slip-off status. The rear-section member 21 slips off to a certain angle where the catch-and-stop pin 13 limits the slippage as shown by the indication lines in FIG. 3.

On the lower end of the fore-section member 12, there is a small rigid hole 141 to accommodate a rigid pin 14. The rigid pin 14 is provided to increase the rigid strength of the fore-section member 12, and also to allow the rear-section member 12 to be positioned.

Figure 5:
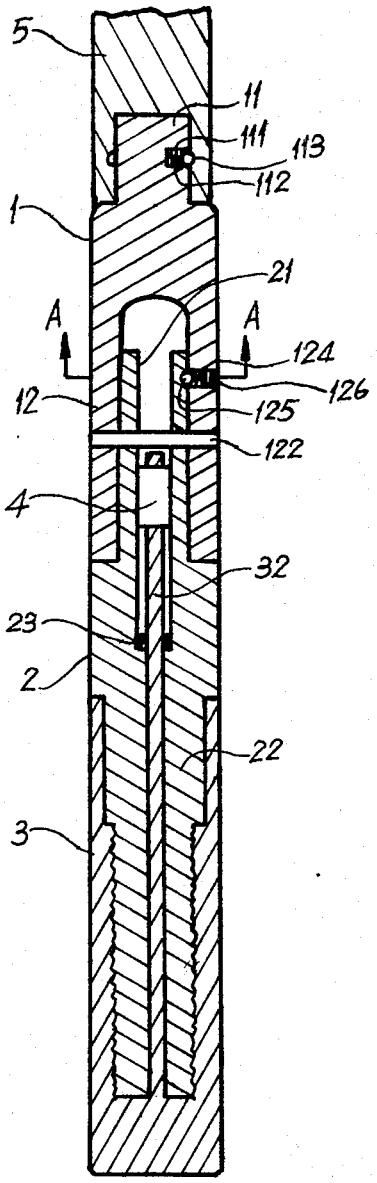
FIG. 5 is a cross-sectional view of the device according to the present invention.

The rear-section rod 2 is shown in FIGS. 1, 2 and 5. The rear-section member 21 has a coupling hole 213, and several round holes 211 which are provided to be coupled with coupling pin 122, and steel bead 125, respectively. The prestress coupling faces between the rear-section member 21 and the fore-section member 12 form parallel planes or oblique planes. The fore-section member 12 "sandwiches" the rear-section member 21 and couples it via coupling pin 122.

Also on the rear-section double fork rod is a step round hollow rod 22. The outer threads of the step round hollow rod 22 match the inner threads 31 on the operational handle 3. Along the center axis of the rear-section rod 2 is a through hole to accommodate and hold link shaft 32 of the operational handle 3. At the top of this through hole, a bearing ring 23 is provided to support link 32.

The operational handle 3 is shown in FIGS. 1, 2, and 5. Its structure is a hollow cylinder with a link shaft 32, projecting upward from the center of the base of the cylinder. Link shaft 32 passes through the through hole of the rear-section rod 2. At the distal end of link shaft 32, the adjustment block 4 is fastened. On the inside surface of the operational handle are inner threads 31, provided to receive the outer threads of step round hollow rod 22 of the rear-section rod 2.

The sliding adjustment block is shown in FIGS. 2, 3, 4 and 5. This block is coupled between the rear-section member 21 of the rear-section rod 2. Inner hole 41 of block 4 accommodates link shaft 32. Rotation of the operational handle 3 drives (via line shaft 32) the block 4 between the rear-section members. This movement adjusts the relative pressure on the prestress coupling faces since as the block moves upward, movement of the flanges of the rear-section rod away from the pressure exerted by the prongs of the fore-section rod, is more restricted. Also, the flanges of the rear-section may slant toward each other, either by the force of the steel bead 125, the compression force of coupling pin 122, or by design in which case the prestress coupling forces are oblique. As the block moves upward between flanges slanted toward each other, it will force the flanges outward, thus increasing the pressure on the prestress coupling faces. The pressure is indicated by the graduated scale on the step round hollow rod 22.

In addition to the embodiment noted above, the present invention can be designed with a fore-section rod 1 as a single integral body, or in the form of a two-section assembly. The indentations on the prestress coupling faces can be designed to have a single-side slope or double-side slopes as shown in FIGS. 4-1, 4-2 and 4-3. The indentations of the prestress coupling faces can be grooves, slots or concave arcs of various depths. The prestress coupling faces can be oblique planes.

Figure 6:
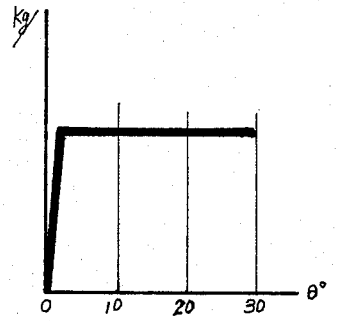
FIG. 6 is the breakaway curve of the torque strength of the device according to the present invention.
Figures 1, 4:
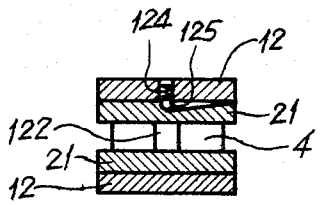
Figures 2, 4:
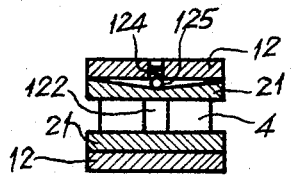
Figures 3, 4:
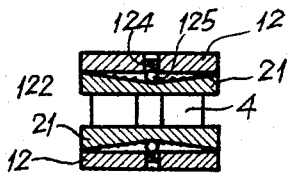

The operation and features of the present invention are as follows: the wrench of this invention clamps a bolt or nut, adjustments are made by turning the operational handle 3 which moves the adjustment block 4 which, in turn, changes the pressure on the prestress coupling faces between the fore-section member 12 and the rear-section member 21, thus setting a maximum safe torque. The amount of torque is indicated by the graduated scale on the step round hollow rod 22. As shown in FIG. 6, if the force applied to the handle 3 does not exceed a safe torque, such force can be continuously applied. If the applied force exceeds a safe torque, the fore-section member 12 and the rear-section member 21 mutually break away in a staggered movement while the position audio alarm device continuously makes audible signals. When the rear-section rod 2 breaks away, it rotates about the coupling pin 122 until it is stopped by the catch-and-stop pin 13 as shown by the dotted lines in FIG. 3. Thus, the present invention prevents nuts and bolts from being damaged.

I claim:

1. A torque wrench for limiting the magnitude of torque applied to a load comprising:

a fore-section rod having a head structure of a wrench at a first end thereof and a fore-section member at a second end thereof, said fore-section member forming two prongs having opposing spaced prestress coupling faces on the interior thereof defining a cavity, and exterior faces, a rear-section rod having a rear-section member, pivot means for connecting said fore-section member to said rear-section member, and for permitting pivoting of said rods, said rear-section rod having upper and lower ends, said rear-section member at said upper end forming two flanges having interior surfaces on the interior sides of said flanges, and prestress coupling surfaces on the exterior sides of said flanges, said flanges received in said cavity with said prestress coupling surfaces in engagement with said prestress coupling faces of said prongs, one of said prestress coupling surfaces having indentations in an arc-shaped pattern, a position audio alarm means for making an audible sound when said rods pivot, in which a protrusion means for restricting the pivoting of said rods on one of said prestress coupling faces of said fore-section member is received by one of said indentations on said rear-section member, and means for varying the amount of restriction provided by said protrusion means.

2. A torque wrench for limiting the magnitude of torque applied to a load comprising:

a fore-section rod having first and second ends, a head structure of a wrench at said first end, a fore-section member at said second end, said fore-section member forming two prongs having opposing spaced prestress coupling faces on the interior defining a cavity, and exterior faces, a rear-section rod having a rear-section member, pivot means for connecting said fore-section member to said rear-section member, and for permitting pivoting of said rods, said rear-section rod having upper and lower ends, said rear-section member at said upper end forming two flanges having interior surfaces on the interior sides of said flanges, and prestress coupling surfaces on the exterior sides of said flanges, said flanges received in said cavity with said prestress coupling surfaces in engagement with said prestress coupling faces of said prongs, one of said prestress coupling surfaces having indentations in an arc-shaped pattern, an operational handle, a step round hollow rod at said lower end of said rear-section member, adjustment means for connecting said step round hollow rod to said operational handle, said operational handle having a hollow cylinder with a base and a link shaft projecting outward from the center of said base of said cylinder, said link shaft passing through said step round hollow rod and having an adjustment block connected to its distal end, said adjustment block is driven by said adjustment means and is movably received between said interior surfaces of said rear-section member, a position audio alarm means for making an audible sound when said rods pivot, in which a protrusion means for restricting the pivoting of said rods on one of said prestress coupling faces of said fore-section member, is received by one of said indentations on said rear-section member, wherein an audible sound is made when said protrusion means moves from one of said indentations to another of said indentations which occurs when the magnitude of the torque applied to the load causes pivoting of said rods.

3. A torque wrench as in claim 2 wherein said fore-section rod has mounting means for detachably receiving said head structure of a wrench.

4. A torque wrench as in claim 3 wherein said mounting means is a cylinder on said fore-section rod with a hole on the wall of said cylinder for receiving a spring-biased detent bead, said small detent bead is also received by a groove in the wall of an opening of said head structure of a wrench corresponding to said cylinder, such that said head structure is rotatable on said cylinder.

5. A torque wrench as in claim 4 wherein said wrench is an adjustable wrench.

6. A torque wrench as in claim 2 wherein said fore-section member has a coupling hole in both of said prongs, a rigid hole in both of said prongs, a catch-and-stop hole in both of said prongs, and a small hole passing through one of said prongs, and said rear-section member has a second coupling hole in both of said flanges.

7. A torque wrench as in claim 6 further comprising a catch-and-stop pin passing through said catch-and-stop hole and fastened to said fore-section member, for strengthening the pivoting of said rods, a rigid pin passing through said rigid hole and fastened to said fore-section member for strengthing the fore-section member, and for limiting the pivoting of said rods when said rods are returned to an operational position.

8. A torque wrench as in claim 6 wherein said pivot means is a coupling pin passing through said coupling holes and said second coupling holes, and fastened to said fore-section member.

9. A torque wrench as in claim 6 wherein said pivot means is a nut and bolt passing through said coupling holes and said second coupling holes wherein said nut and bolt are adjusted to alter the pressure between said prestress coupling faces and said prestress coupling surfaces.

10. A torque wrench as in claim 6 wherein said protrusion means is a spring-biased detent ball and an adjustment screw inserted in said small hole of one of said prongs wherein said adjustment screw is rotated to adjust pressure between said detent ball and one of said indentations.

11. A torque wrench as in claim 2 wherein said protrusion means is on both of said prestress coupling faces of said fore-section member; and both of said prestress coupling surfaces have indentations in an arc-shaped pattern, said protrusion means being received by indentations on said prestress coupling surfaces.

12. A torque wrench as in claim 2 wherein said adjustment means are outer threads at the distal end of said step round rod and threadably received by inner threads on the inside surface of said operational handle; said step round hollow rod having a graduated scale between said outer threads and said rear-section member.

13. A torque wrench as in claim 2 wherein said prongs are slanted slightly away from each other, and said flanges are slanted slightly toward each other.

* * * * *